US009499176B2

(12) United States Patent
Chedal Bornu

(10) Patent No.: US 9,499,176 B2
(45) Date of Patent: Nov. 22, 2016

(54) SKI LIFT SEAT HAVING A MAGNETIC LOCK FOR RESTRAINING BAR

(75) Inventor: Yves Chedal Bornu, Bozel (FR)

(73) Assignee: SOMMITAL, Chambery (FR)

( * ) Notice: Subject to any disclaimer, the term of this patent is extended or adjusted under 35 U.S.C. 154(b) by 341 days.

(21) Appl. No.: 13/994,989

(22) PCT Filed: Nov. 16, 2011

(86) PCT No.: PCT/FR2011/052662

§ 371 (c)(1),
(2), (4) Date: Jul. 3, 2013

(87) PCT Pub. No.: WO2012/080603

PCT Pub. Date: Jun. 21, 2012

(65) Prior Publication Data

US 2013/0269567 A1 Oct. 17, 2013

(30) Foreign Application Priority Data

Dec. 17, 2010 (FR) ..... 10/60742

(51) Int. Cl.
*B61B 12/00* (2006.01)

(52) U.S. Cl.
CPC ..... *B61B 12/002* (2013.01)

(58) Field of Classification Search
CPC ..... B61B 12/028; B61B 12/002; B61B 12/00; A63G 7/00; B60R 2021/0097; B60R 21/02; B60R 2021/022; B60R 22/04; Y10T 292/11; Y10T 70/7057
See application file for complete search history.

(56) References Cited

U.S. PATENT DOCUMENTS 4,763,937 A * 8/1988 Sittnick, Jr. ..... E05B 49/00 292/251.5
5,038,128 A * 8/1991 Georgiev ..... B66C 1/04 294/65.5

(Continued)

FOREIGN PATENT DOCUMENTS

| | | | |
|---|---|---|---|
| CN | 101081618 | A | 12/2007 |
| CN | 101716937 | A | 6/2010 |
| EP | 2030858 | A2 | 3/2009 |
| FR | 2937937 | A1 | 5/2010 |
| FR | 2969100 | A1 | 6/2012 |

(Continued)

OTHER PUBLICATIONS

International Search Report issued Jan. 17, 2012—re: PCT/FR2011/052662; citing: WO 2007/135256 A1, EP 2 030 858 A2, WO 2008/129017 A1 and FR 2 937 937 A1.

*Primary Examiner* — Mark Le
(74) *Attorney, Agent, or Firm* — Cantor Colburn LLP

(57) ABSTRACT

Ski lift seat including a frame and a restraining bar which is capable of assuming a first lowered end position defining an enclosed space that makes it possible to prevent a passenger from falling, and a second lifted end position in which the restraining bar frees up the front space of the seat so as to enable one or more passengers to disembark, the ski lift seat including an arrangement for locking the restraining bar when the latter assumes the lowered position, the arrangement including a first magnetic member which is attached on the frame and which engages with a second member that can be magnetized so as to hold the restraining bar in the lowered position.

14 Claims, 7 Drawing Sheets

(56) References Cited

U.S. PATENT DOCUMENTS

| | | | | |
|---|---|---|---|---|
| 6,494,145 | B2 * | 12/2002 | Kernan | B61B 12/028 104/28 |
| 2009/0115204 | A1 * | 5/2009 | Rycroft | E05B 63/20 292/341.17 |

FOREIGN PATENT DOCUMENTS

| | | | |
|---|---|---|---|
| WO | 2007135256 | A1 | 11/2007 |
| WO | 2008129017 | A1 | 10/2008 |
| WO | 2010052426 | A2 | 5/2010 |
| WO | 2012080603 | A1 | 6/2012 |

* cited by examiner

SKI LIFT SEAT HAVING A MAGNETIC LOCK FOR RESTRAINING BAR

TECHNICAL FIELD

The present invention relates to a ski lift facility.

BACKGROUND

Traditionally, a ski lift facility allows passengers, skiers or pedestrians, to go up or down slopes. A ski lift generally includes two end stations, one station located at the bottom of the slope and another station located at the top of the slope. These end stations are connected by an overhead carrier and pulling cable that may form a closed loop. It is known to drive the cable using pulleys and to support it using pylons. Vehicles suspended from the cable make it possible to convey passengers from one end station to another.

Several types of ski lifts exist: chairlift, ski tow, gondola lift, or aerial ropeway. A chairlift-type ski lift allows passengers to go up or down the slope, in a seated position, using seats suspended from a continuously moving cable. A ski lift of the ski tow type makes it possible to pull skiers on their own skis to go up the slope. A facility of the gondola lift type consists of conveying passengers using gondolas suspended from a continuously moving cable. Lastly, a lift of the aerial ropeway type makes it possible to convey passengers to the top or bottom of the slope with a back-and-forth movement. In other words, the movement is reversed at the end stations.

When the cable forms a closed loop, each end station may include a boarding area and a disembarking area for passengers. The ski lift thus offers the possibility of simultaneously conveying passengers going up and down the slope.

When the ski lift is of the chairlift type, the vehicles (seats) may or may not be disengageable. When they are disengageable, the seats can be separated from the cable from which they are suspended to follow a secondary path when they reach a boarding or disembarking area. On the secondary path, the speed of the seat is reduced to facilitate boarding or disembarking passengers, thereby procuring increased comfort and safety. When the seats are not disengageable, they remain permanently on the cable from which they are suspended. In that case, the lack of a disengaging system offers a ski lift with a simpler structure.

The transport of passengers at the top or bottom of the slope requires compliance with a high level of safety. In particular, the seats travel at a relatively significant distance from the ground. It is thus known from patent document WO2007/135256 to improve passenger safety by using a magnetic member engaging with an element made from a ferromagnetic material worn by a passenger.

It is also known to improve passenger safety by using a restraining bar limiting risks of accidental fall of a passenger from the seat.

The restraining bars are traditionally pivotably mounted with respect to the seat to allow passengers to board and disembark. A distinction is made between a lowered usage position and a lifted usage position of the restraining bar. When the restraining bar is in the lowered position, it forms an obstacle preventing a passenger from falling into the open space. This lowered position of the restraining bar is normally adopted during a travel phase of the seat outside the loading and disembarking areas. When the restraining bar is in a lifted position, it frees the space in front of the seat so as to allow the passengers to position themselves on the seat or leave it. The restraining bar is therefore normally in the lifted position when the seat is in a boarding or disembarking area.

For safety reasons, the restraining bar must not be lifted throughout the entire travel phase outside the boarding and disembarking areas. However, the existing seats generally only offer limited security, insofar as nothing prevents passengers from lifting the restraining bar during the travel of the seat outside the boarding and disembarking areas.

To resolve this issue, it is known to use mechanical blocking devices of the restraining bar, like that disclosed in patent document EP 2,030,858. However, these mechanical devices impose a structure that is oftentimes complex. As a result, these devices only offer the possibility of being able to be mounted on vehicles during construction. They cannot be adapted to existing ski lifts and furthermore require relatively significant maintenance. Lastly, although they improve passenger safety, the known devices make the vehicles heavier, which causes early wear of the ski lift vehicles.

BRIEF SUMMARY

Consequently, the present invention aims to resolve all or some of the aforementioned drawbacks.

To that end, the present invention relates to a ski lift seat comprising a frame and a restraining bar which is capable of assuming a first lowered end position defining an enclosed space that makes it possible to prevent a passenger from falling, and a second lifted end position in which the restraining bar frees up the front space of the seat so as to enable one or more passengers to disembark, characterized in that the ski lift seat comprises a means for locking the restraining bar when the latter assumes the lowered position, the locking means comprising a first magnetic member which is attached on the frame and which engages with a second member that can be magnetized so as to hold the restraining bar in the lowered position.

The invention thus offers a restraining bar locking device doing away with the mechanical constraints typically encountered with locking means for the restraining bar comprising purely mechanical locking means. This can in particular be verified in terms of maintenance, since the magnetic elements require little or no (time-consuming and costly) maintenance, as well as in terms of weight of the seat, since the locking devices for the restraining bar include only mechanical locking means making the seats heavier (causing early wear thereof). Furthermore, the locking means according to the present invention include elements fastened on the ski lift seat and not on the restraining bar. Thus, the locking means for the restraining bar can be fastened on existing ski lift seats, without requiring substantial modifications to the structure of the seat for that purpose.

According to another advantageous feature of the ski lift seat according to the invention, the locking means include a switch connected to the frame of the seat by a pivot link.

Advantageously, the switch includes two ends respectively made up of a locking member and the magnetizable member.

Preferably, the restraining bar includes stop means designed to bear against the blocking member and the magnetizable member is capable of bending when it comes into contact with the magnetic member.

Thus, the rotation of the restraining bar causes the switch to rotate, and consequently causes the magnetic member and the magnetizable member to come into contact.

Advantageously, the switch includes reinforcing means capable of stiffening the magnetizable member, such that the magnetizable member is capable of bending in only one direction.

Preferably, the seat includes return means connected to the end of the switch and the frame of the seat.

This feature has the advantage of facilitating separation of the magnetizable member from the magnetic member and favoring the quick return of the switch to a stable equilibrium position.

According to another feature of the ski lift seat according to the invention, the blocking member comprises two walls, the first wall being oriented on the frame side, and the second wall having an edge delimiting two surfaces of the second wall, one surface parallel to the first wall and one surface inclined relative to the first wall and adjacent to the first wall.

Thus, the lifting of the restraining bar toward a lifted position from a lowered position is facilitated and the amplitude of the movement of the end of the switch is limited.

According to one embodiment, the switch and the magnetic member are situated under the seat.

Advantageously, the switch comprises a first end on which the magnetizable member is fastened and a second end configured to receive and lock a restraining bar element.

According to one embodiment, the second end comprises a bearing surface and a blocking surface, the bearing surface and the blocking surface delimiting a housing designed to receive the restraining bar element.

Advantageously, the seat comprises return means opposing the movement of the second end of the switch toward the magnetic member.

Preferably, the magnetic member includes an electromagnet electrically connected to electrical conductors onboard the ski lift seat.

Thus, if the electromagnet is supplied with electricity, it generates a magnetic field opposing the magnetic field of the magnetic member, making it possible to separate the magnetizable member from the magnetic member.

According to another embodiment, the seat comprises mechanical unlocking means for the restraining bar.

Advantageously, the mechanical unlocking means comprise a lever and control means for controlling the lever.

According to one possibility, the control means for controlling the lever comprise a movable control member attached to a hanger of the seat, a mechanical control cable connected to the movable control member and to the lever, and return means opposing the movement of the movable control member toward a position actuating the lever in which the mechanical control cable pulls the lever.

According to one embodiment, the movable control member comprises a control switch pivotably mounted on the hanger, the control switch comprising a first end to which the mechanical control cable is attached and a second end comprising a bearing member designed to bear against a ramp.

Preferably, the bearing member is a roller pivotably mounted on the second end.

Advantageously, the magnetic member is a permanent magnet.

Preferably, the magnetizable member is a metal plate.

The present invention also relates to a ski lift facility, in particular of the ski chair type, comprising at least one ski lift seat according to the invention.

BRIEF DESCRIPTION OF THE DRAWINGS

The aims, aspects and advantages of the present invention will be better understood upon reading the following description of one embodiment of the present invention, provided as a non-limiting example, in reference to the appended drawings, in which.

DETAILED DESCRIPTION

Figure 1:
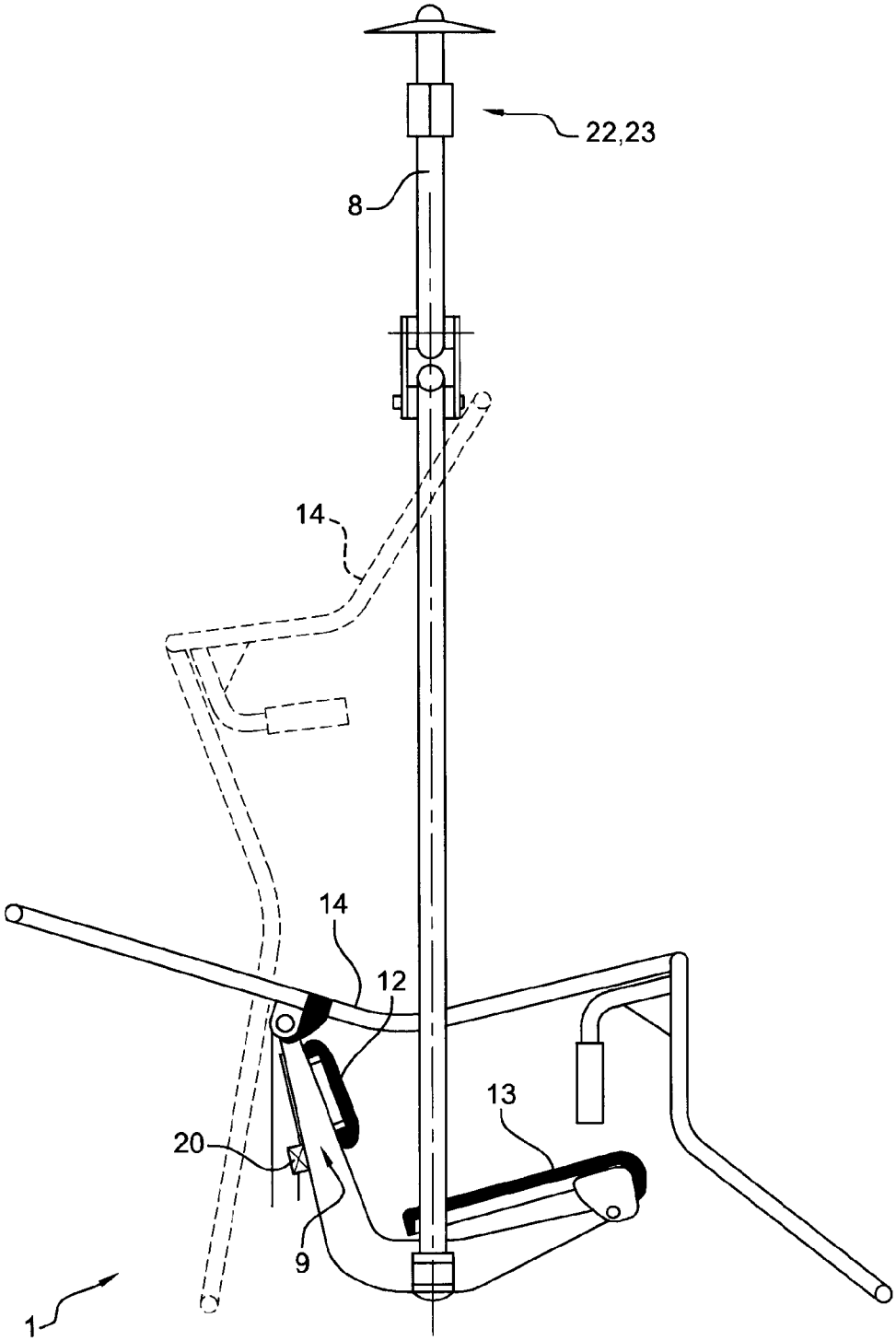
FIG. 1 is a profile view of a ski lift seat according to one particular embodiment of the invention.
Figure 3:
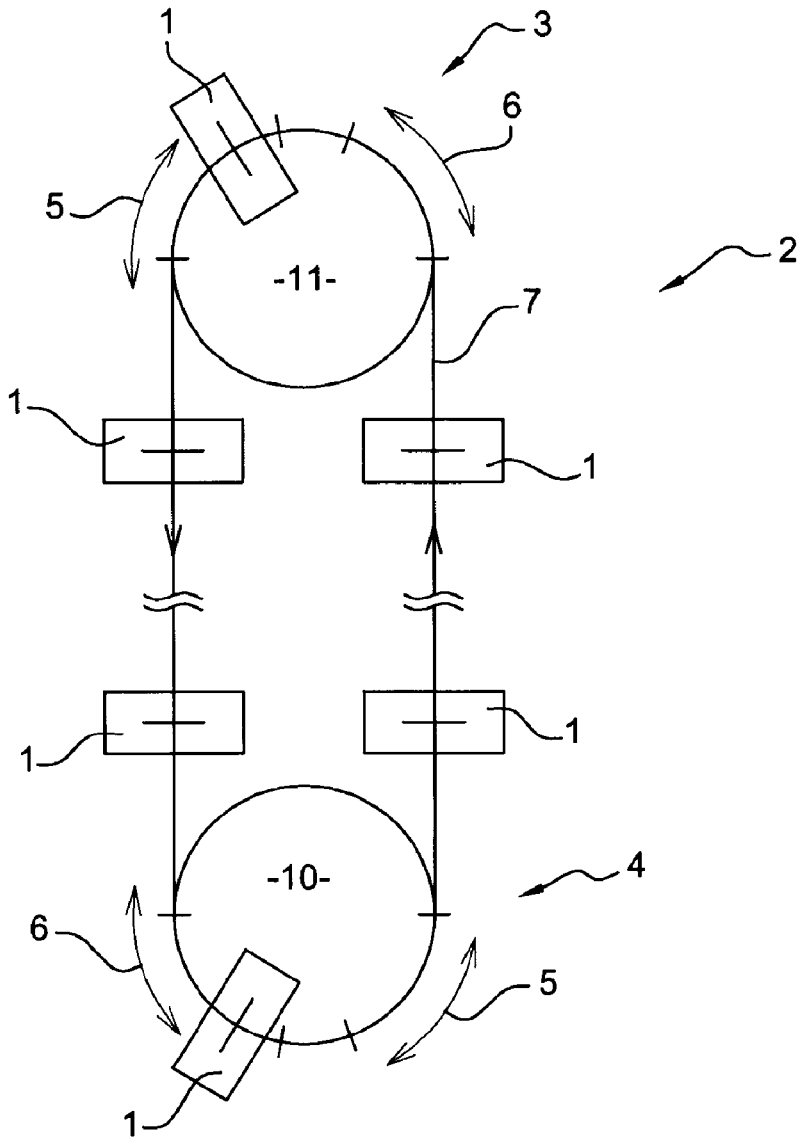
FIG. 3 is a diagrammatic top view of a ski lift facility equipped with seats according to one particular embodiment of the invention.

FIG. 1 shows a seat 1 of a ski lift facility 2. The ski lift facility 2 is shown in FIG. 3. The ski lift facility 2 may in particular be of the ski chair type and include two end stations 3, 4. Each end station 3, 4 may include a passenger boarding area 5 and a passenger disembarking area 6, as shown in FIG. 3.

The ski lift seat 1 is suspended from an overhead pulling cable 7 by a hanger 8. The cable 7 is supported by pylons, not shown in the various figures. The seat 1 includes a frame 9 to which the hanger 8 is connected. The cable 7 forms a closed loop and is driven by pulleys 10, 11.

As shown in FIG. 1, the seat 1 includes a backrest 12 and a seating surface 13. The frame 9 of the seat 1 has a bent shape, such that the ends of the frame 9 form the backrest 12 and the seating surface 13. The backrest 12 and the seating portion 13 make it possible to support one or more passengers during transport. The seat 1 also includes a restraining bar 14. The restraining bar 14 is connected to the frame 9 of the seat 1, for example by a pivot link P1.

The pivot link P1 allows a rotational movement of the restraining bar 14, along the same axis as the pivot link P1. The rotation of the restraining bar 14 occurs between two end usage positions of the restraining bar 14: a so-called "lowered" position, and a so-called "lifted" position. When the restraining bar 14 is in the lowered position, it defines an enclosed space corresponding to a secure space inside which the passengers are located during travel of the seat 1 outside the boarding 5 and disembarking 6 areas. Thus, the restraining bar occupying a lowered position contributes to passenger safety by preventing a risk of the passengers' seat 1 tilting forward, and the passengers therefore falling. When the restraining bar 14 is in a lifted usage position, it frees the space in front of and next to the seat 1. It is thus possible for the passengers to exit the seating surface 13 by moving toward the front of the seat 1, or to position themselves on the seat 1 by placing themselves in front of it. This is in particular the case when the seat 1 travels over a boarding area 5 or a disembarking area 6.

The ski lift seat 1 also includes locking means for the restraining bar 14, when the restraining bar 14 is in a lowered position. This makes it possible to significantly increase passenger safety, by preventing passengers from lifting the restraining bar 14 once it has been placed in the lowered position to secure the travel of the seat 1 between the end stations 3, 4. The locking means in particular comprise a magnetic member 20 and a magnetizable member 15. This makes it possible to eliminate the constraints typically encountered with locking means comprising only mechanical locking means for the restraining bar, i.e., a complex structure, which is difficult to adapt to ski lift seats due to that complexity and due to the structural modifications required for the restraining bar, and having a relatively significant weight causing rapid wear of the seats 1 equipped with those locking means.

Figure 2:
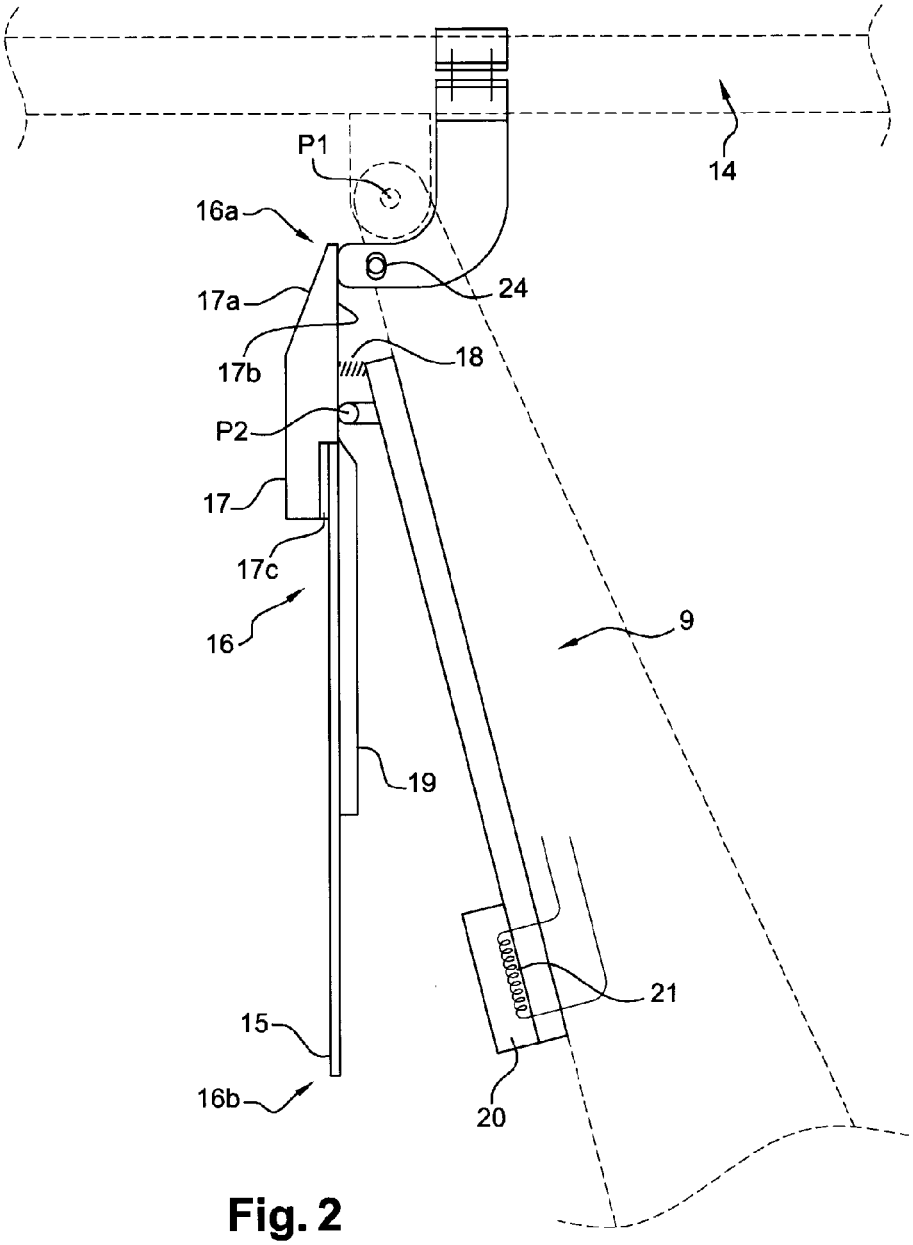
FIG. 2 is a view of a detail of FIG. 1 illustrating a magnetic locking device mounted on a ski lift seat according to one particular embodiment of the invention.

As shown in FIG. 2, the locking means comprise a magnetizable member 15. The member 15 is made from a magnetic material. A magnetic material is any material capable of being magnetized when it is submerged in an outside magnetic field. In the described embodiment of the present invention, the magnetizable member 15 is a metal plate, for example a stainless steel plate. Furthermore, it is important to note that the magnetizable member 15 can bend when it is subjected to a stress normal to a plane parallel to the plane defined by the metal plate 15.

The locking means also include a switch 16. In the described embodiment, the switch 16 includes a blocking member 17 and the magnetizable member 15. The blocking member 17 and the magnetizable member 15 respectively make up the ends 16*a*, 16*b* of the switch 16.

Return means, for example a draw spring 18, can be placed between the ends 16*a* (blocking member 17) of the switch 16 and the frame 9 of the seat 1. The function of the draw spring 18 will be outlined hereafter.

As shown in FIG. 2, the blocking member 17 in particular comprises two walls 17*a* and 17*b*. The wall 17*a* has an edge delimiting the wall 17*a* in the form of a surface parallel to the wall 17*b* and a surface that is inclined with respect to the wall 17*b*. The wall 17*b* is positioned on the backrest 12 side, as shown in FIG. 2.

The blocking member 17 is connected to the frame 9 by a pivot link P2. The axis of rotation of the blocking member 9 is substantially parallel to the axis of rotation of the restraining bar 14. The pivot link P2, according to the principle of any switch, is situated on an intermediate part of the switch 16, between the ends 16*a* and 16*b*.

The magnetizable member 15 (end 16*b*) can be fastened to the blocking member 17 by screws, bolts or rivets. A reinforcing plate 19 is placed against the magnetizable member 15, which it partially covers. The reinforcing plate 19 is positioned on the upper part of the magnetizable member 15, i.e., the part of the magnetizable member 15 close to the pivot link P2. The lower part of the magnetizable member 15 is not covered by the reinforcing plate 19. The reinforcing plate 19 is placed on the side of the magnetizable member 15 oriented toward the backrest 12. Thus, the magnetizable member 15 retains its flexibility in only one direction, corresponding to a direction substantially opposite the direction of movement of the seat 1.

As shown in FIG. 2, the blocking member 17 includes a shoulder 17*c* against which the magnetizable member 15 bears. The upper part of the magnetizable member 15 is sandwiched between the shoulder 17*c* and the reinforcing plate 19, fastened to the magnetizable member 15 for example by bolting.

The locking means also include a magnetic member 20. The magnetic member 20 is a permanent magnet. The magnetic member 20 is fastened to the frame 9 of the ski lift seat 1. The magnetic member 20 is designed to engage with the magnetizable member 15 to participate in locking the restraining bar 14 in the lowered position. Thus, the magnetic member 20 is situated substantially equidistant from the pivot link P2 and the lower part of the magnetizable member 15 with which it engages.

It should be noted that the magnetic member 20 integrates an electromagnet, for example a coil 21. The coil 21 is electrically connected to electrical conductors 22, 23, as described in document WO 2010/052426, situated on the hanger 8.

When the ski lift seat 1 leaves a boarding area 5, the passengers seated on the seating surface 13 lower the restraining bar 14. As shown in FIG. 2, the restraining bar 14 includes stop means, for example a lug 24 whereof of the axis is parallel to the axis of rotation of the restraining bar 14. The lug 24 bears against the wall 17*b* of the blocking member 17 when the restraining bar is lowered. Thus, the rotational movement of the restraining bar 14 due to the lowering thereof causes the application of a force on the end 16*a* (blocking member 17) of the switch 16. The switch 16 then pivots around the axis of the pivot link P2, causing its other end 16*b* to move and the magnetizable member 15 to come into contact with the magnetic member 20. The magnetic field created by the magnetic member 20 causes the attraction and maintenance in position of the magnetizable member 15 against the magnetic member 20.

At this stage, the restraining bar 14 has not yet reached its lowered position and is not yet locked.

By continuing to lower the restraining bar 14, the magnetizable member 15 bends, until it allows the lug 24 to cross the end 16*a* of the switch 16. The lug 24 is thus located on the other side of the blocking member 17, against the wall 17*a* thereof.

At this stage, the restraining bar 14 is locked in its lowered position. It is no longer possible for passengers to lift it. In fact, the blocking member 17 acts as a non-return pawl. The blocking member 17 contributes to preventing lifting of the restraining bar 14 from its lowered position. If one of the passengers, intentionally or accidentally, exerts a force seeking to lift the restraining bar 14, the wall 17*a*, against which the lug 24 is pressed, blocks the rotation of the restraining bar 14. The switch 16 cannot pivot, insofar as its end 16*b* is secured to the frame 9 by the engagement of the magnetizable element 15 and the magnetic member 20. The switch 16 also cannot bend, since the reinforcing plate 19 pressed against the magnetizable element 15 prevents bending thereof in a direction corresponding to the direction of forward movement of the ski lift seat 1. Thus, the end 16*a* of the switch 16 forms an insurmountable obstacle placed on the return path of the lug 24. It is impossible for passengers to remove the restraining bar 14 from its lowered position.

When the ski lift seat 1 reaches a disembarking area 6, the electrical conductors 22, 23 come into contact with a conductive brush device subject to an electrical voltage, as described in document WO 2010/052426. Thus, the coil 21, which is electrically connected to the electrical conductors 22, 23, is powered. As a result, it creates a magnetic field opposing the magnetic field of the magnetic member 20. The force necessary to separate the magnetizable element 15 from the magnetic member 20 is substantially reduced and becomes practically or completely nonexistent. Under the effect of its own weight, the end 16*b* of the switch 16 detaches from the magnetic member 20, while pivoting around the axis of the pivot link P2, and tends to adopt a stable equilibrium position. In the described embodiment, this stable equilibrium position substantially corresponds to a vertical position, in particular shown in FIG. 2. When a draw spring 18 is present, it contributes to separating the magnetizable member 15 and the magnetic member 20, and returning the switch 16 to a stable equilibrium position.

The restraining bar 14 is then no longer locked. Passengers then need only lift it for it to leave its lowered position and pivot around the axis of the pivot link P1 toward a lifted position. When the restraining bar 14 is lifted, the lug 24 exerts a force on the wall 17*a* of the blocking member 17 (end 16*a* of the switch 16). The end 16*b* of the switch 16 no longer being secured to the magnetic member 20 and being free to move, the force exerted by the lug 24 during lifting of the restraining bar 14 causes the forced rotation of the switch 16 around the axis of rotation of the pivot link P2, until the lug 24 has once again crossed the obstacle formed by the blocking member 17 (end 16*a* of the switch 16). The restraining bar 14 can continue to rotate until it reaches a lifted end position. The inclined surface of the wall 17*a* with respect to the wall 17*b* favors the return of the lug 24 on the other side of the blocking member 17. The inclined surface of the wall 17*a* also makes it possible to limit the travel of the end 16*b* necessary for the lug 24 to cross the blocking member 17.

Once the ski lift seat 1 leaves the disembarking 6 or boarding 5 area, the electrical contact between the conductive brush device and the electrical conductors 22, 23 is broken. Thus, the coil 21 is no longer supplied with electricity. The magnetic field of the magnetic member 20 is again imposed. As a result, the lowering of the restraining bar 14 to a lowered end position once again leads to locking thereof.

According to another particular embodiment, illustrated in FIGS. 4 and 5 and described below, the locking means of the restraining bar 14 are situated under the ski lift seat 1.

It should be noted that the references are the same for the elements shared by the different described embodiments.

The magnetic member 20 is fixed under the seat 1 here, for example under the seating surface 13.

The magnetizable member 15 here is connected to a first end 31 of a switch 30.

The switch 30 is rotatable with respect to the seat 1. As shown in FIG. 5, the switch 30 can be connected to a flange 33 by a pivot link P2. The flange 33 is secured to the seat 1.

The switch 30 comprises a second end 32. The second end 32 is configured to receive and block a restraining bar element, for example a lug 34 attached to the restraining bar 14. More specifically, the lug 34 may be attached to the foot rest of the restraining bar 14.

Figure 5:
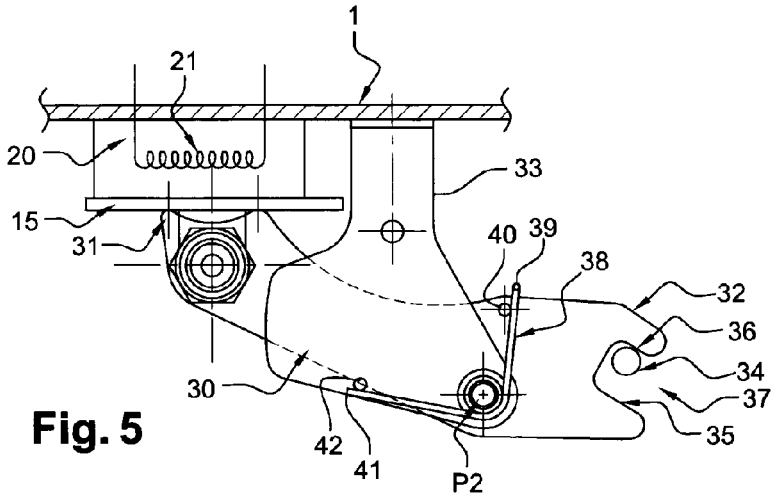
FIG. 5 is a view of a detail of FIG. 4.
Figure 7:
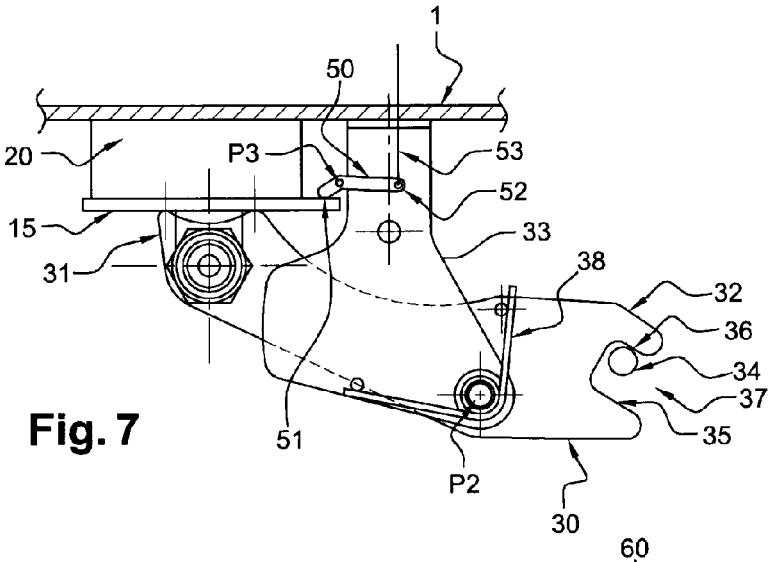
FIG. 7 is a view of a detail of FIG. 6.

As shown in FIG. 5, the second end 32 may be in the shape of a hook.

The second end 32 here comprises a bearing surface 35 and a blocking surface 36. The bearing surface 35 and the blocking surface 36 are arranged to delimit a housing 37. The housing 37 is designed to receive the lug 34.

The switch 30 can pivot between a position receiving the lug 34, in which the housing 37 is positioned so as to receive the lug 34, and a locking position of the restraining bar 14, in which the magnetizable member 15 bears against the magnetic member 20.

In the receiving position, the bearing surface 35 is positioned on the trajectory of the lug 34, while the blocking surface 36 is separated from that trajectory. In the blocking position, the blocking surface 36 is situated across the trajectory of the lug 34.

Return means, for example a torsion spring 38, are arranged to oppose the rotation of the switch 30 from its receiving position to its locked position. The torsion spring 38 here comprises a first end 39, designed to bear against a second lug 40 attached to the switch 30, and the second end 41, designed to bear against a third lug 42 attached to the flange 33.

During operation, starting from an initial situation in which the seat 1 is in a boarding area 5, the restraining bar 14 is in a lifted position and the switch 30 is in a position for receiving the lug 34.

When the seat 1 leaves the boarding area 5, the lowering of the restraining bar 14 from its lifted position to its lowered position by the passenger(s) of the seat 1 causes the lug 34 to move toward the second end 32 of the switch 30.

The lug 34, engaging in the housing 37 and bearing against the bearing surface 35, causes the switch 30 to rotate around the pivot link P2. This rotation results in elevating the first end 31, until the magnetizable member 15, attached to that first end 31, comes into contact with the magnetic member 20 on the one hand, and the blocking surface 36 moves across the return trajectory of the lug 34 on the other hand.

The engagement of the magnetizable member 15 and the magnetic member 20 immobilizes the switch 30. The restraining bar 14 is locked in the lowered position.

In fact, the lug 34 is captive in the housing 37. The blocking surface 36 prevents the inverse movement of the lug 34, corresponding to the movement of the restraining bar 14 from its lowered position to its lifted position.

When the seat 1 reaches the disembarking area 6, the coil 21 is powered and neutralizes the magnetic field of the magnetic member 20. The magnetizable member 15 can be separated from the magnetic member 20. The switch 30 is no longer immobilized. The passenger(s) may lift the restraining bar 14 from its lowered position to its lifted position to leave the seat 1. During this operation, the lug 34 bears against the blocking surface 36 and thereby causes the switch 30 to rotate, facilitated by the torsion spring 38.

Figure 4:
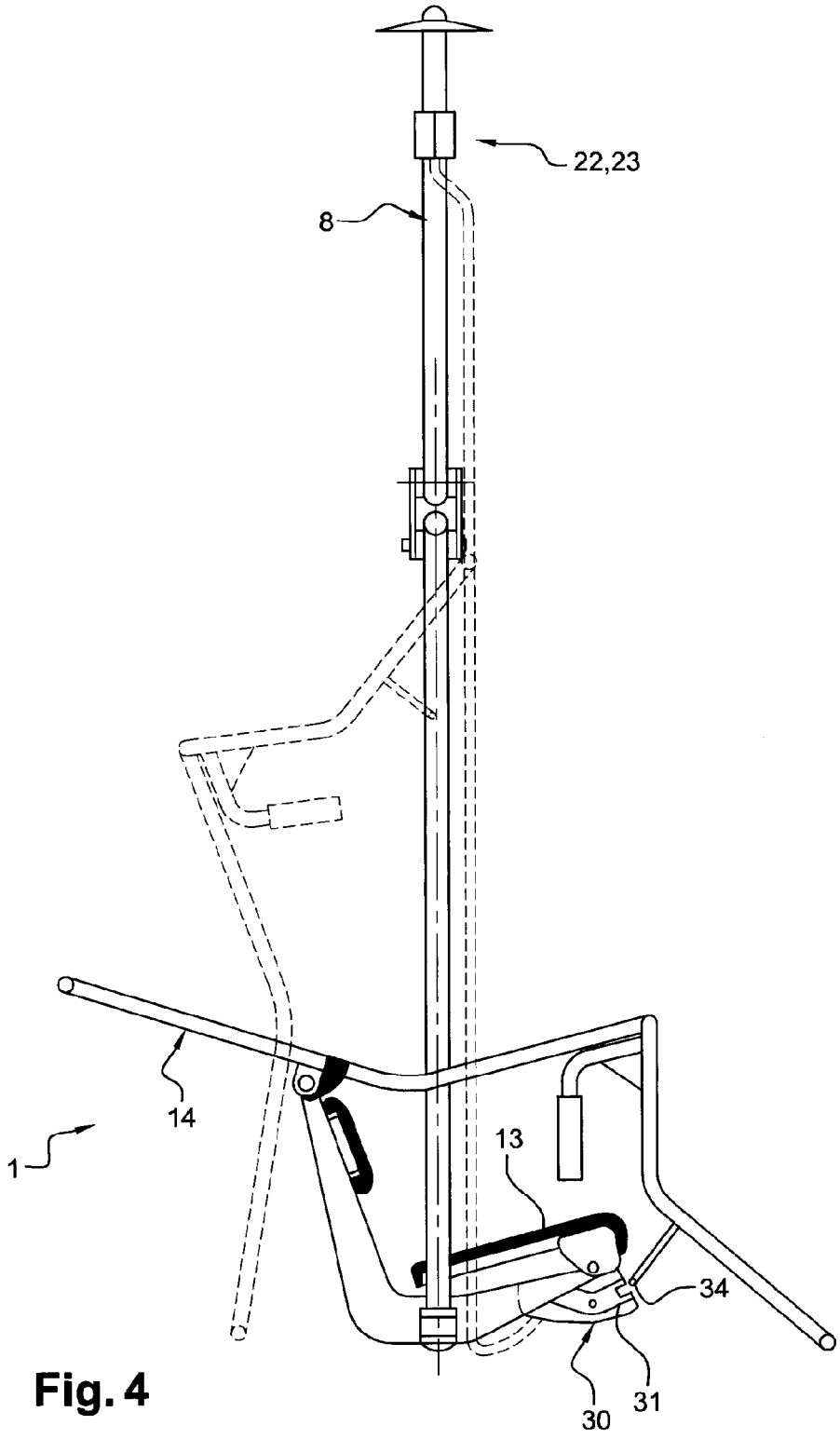
FIG. 4 is a profile view of a ski lift seat according to another embodiment of the invention.

According to one particular embodiment illustrated in FIGS. 6, 7, 8 and 9, the locking of the restraining bar 14 is done similarly to the embodiment illustrated in FIGS. 4 and 5, but the unlocking this time is done mechanically. Consequently, the seat 1 comprises mechanical unlocking means for the restraining bar 14.

It will be noted that, for this embodiment, the magnetic member 20 is provided with no coil 21 designed to be electrically powered. The magnetic field of the magnetic member 20 therefore cannot be neutralized. Furthermore, the seat 1 also does not include electrical conductors 22, 23.

According to this particular embodiment, the mechanical unlocking means comprise a lever 50 and control means for controlling the lever 50.

The lever 50 is pivotably mounted with respect to the seat 1. It can be connected to the seat 1 (or to the flange 33) by a pivot link P3. The lever 50 comprises a first end 51 and a second end 52. The first end 51 is arranged to bear against the magnetizable member 15 when the latter is in contact with the magnetic member 20.

Figure 6:
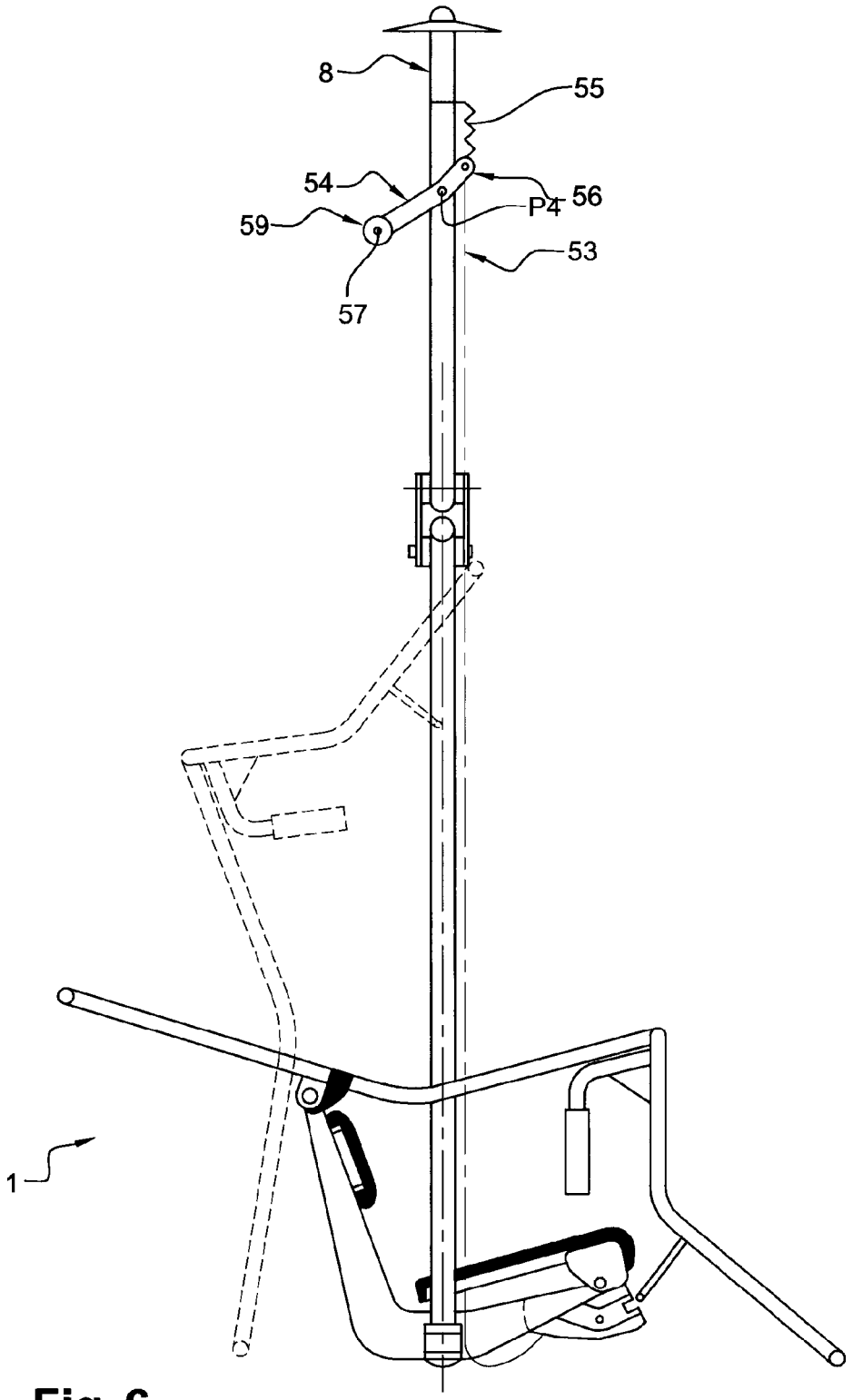
FIG. 6 is a profile view of a ski lift seat according to one particular embodiment of the invention.
Figure 9:
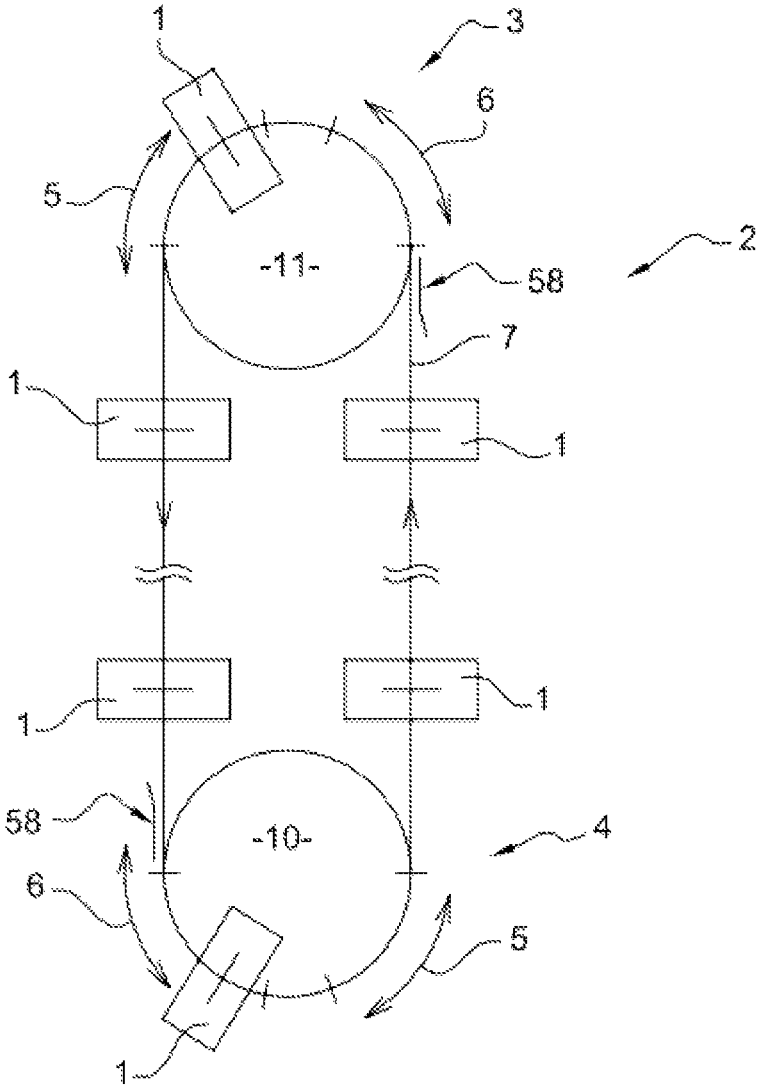
FIG. 9 is a diagrammatic top view of a ski lift facility comprising at least one seat according to this particular embodiment of the invention.

As shown in FIG. 6, the control means comprise a mechanical control cable 53, a control switch 54, and means for returning the control switch 54 to its position, for example a compression spring 55 (depending on the arrangement of the spring, it may also be a draw spring).

The control switch 54 is mounted pivotably with respect to the hanger 8, by means of a pivot link P3. The control switch 54 comprises a first end 56 and a second end 57. The first end 56 is connected to the mechanical control cable 53 (which is further connected to the second end 52 of the lever). The second end 57 is designed to be moved by means of a ramp 58 that will be described in more detail below. This second end 57 comprises a bearing member, for example a roller 59 pivotably mounted on said second end 57.

The compression spring 55 is attached on the one hand to the hanger 8, and on the other hand to the control lever 54. In the example of FIG. 6, the compression spring 55 is attached to the first end 56 of the control switch 54.

Figure 8:
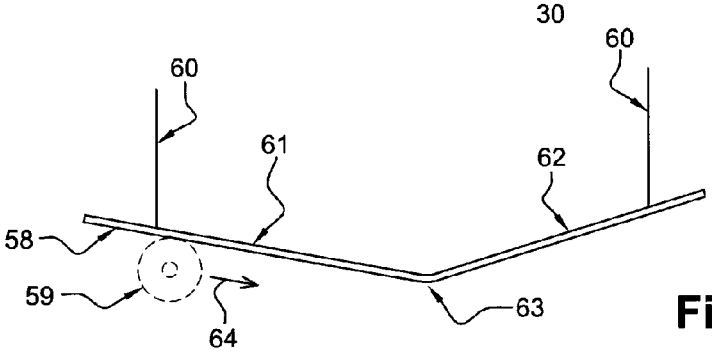
FIG. 8 is a diagrammatic view of a ramp of a ski lift facility comprising at least one seat according to this particular embodiment of the invention.

The ski lift facility 60 comprises at least one ramp 58 arranged on the trajectory of the roller 59, as shown in FIG. 8. Each ramp 58 is attached to the stationary structure of the ski lift facility 60, at the entry or in the disembarking area(s) 6.

The ramp 58 comprises at least one oblique portion 61 to cause the control switch 54 to rotate. According to the example of FIG. 8, the ramp 58 comprises an oblique portion 61 at the entry and an oblique portion 62 at the exit. Between these two oblique portions 61, 62, an intermediate portion 63 is provided making it possible to keep the control switch 54 in an unlocked position of the restraining bar 14 (shown in FIG. 6), allowing a passenger to move the restraining bar 14 from its lowered position to its lifted position.

During operation, the locking of the restraining bar 14 is done similarly to the embodiment illustrated in FIGS. 4 and 5. The placement of the magnetizable member 15 in contact with the magnetic member 20 automatically causes them to be secured to each other, since the magnetic member 20 does not comprise a coil 21 designed to create a magnetic field opposing that of the magnetic member 20.

When the seat 1 reaches the entry or is in a disembarking area 6, the roller 59 bears against and under the ramp 58, as shown in FIG. 8. The movement of the roller 59 (with the seat 1, in the direction of the arrow 64) under the oblique portion 61 causes the control switch 54 to rotate. This rotation results in pulling the mechanical control cable 53, which moves the second end 52 of the lever 50 accordingly.

The rotation of the lever 50 causes its first end 51 to bear against the magnetizable member 15, until it is now secured to the magnetic member 20. The first end 51 exerts a force on the magnetizable member 15 tending to separate it from the magnetic member 20. This force is sufficient for an air gap to be created between the magnetizable member 15 and the magnetic member 20. This air gap makes it possible to separate the magnetizable member 15 and the magnetic member 20 when a passenger lifts the restraining bar 14. The restraining bar 14 can thus be unlocked.

When the roller 59 leaves the intermediate portion 63 of the ramp 58, the control switch 54 pivots in the opposite direction under the effect of the compression spring 55. The lever 50 also pivots in the opposite direction. Its first end 51 moves away from the magnetizable member 15. The position of the lever 50 therefore again makes it possible to put the magnetizable member 15 in contact with the magnetic member 20 to lock the restraining bar 14.

Thus, the ski lift seat 1 has magnetic locking means preventing the restraining bar 14 from being lifted once it is placed in an end lowered position during travel of the seat 1 outside a boarding 5 or disembarking 6 area, and allowing the restraining bar 14 to be lifted to a lifted end position during travel of the seat 1 into a boarding 5 or disembarking 6 area.

Of course, the invention is not limited to the embodiment described above, that embodiment having been provided solely as an example. Modifications remain possible, in particular regarding the composition of the various elements or the substitution of technical equivalents, without going beyond the scope of protection of the invention. Thus, the ski lift seats 1 may or may not be disengageable.

The invention claimed is:

1. A ski lift seat comprising a frame and a restraining bar which is capable of assuming a first lowered end position defining an enclosed space that makes it possible to prevent a passenger from falling, and a second lifted end position in which the restraining bar frees up the front space of the seat so as to enable one or more passengers to disembark, wherein the ski lift seat comprises a means for locking the restraining bar when the latter assumes the lowered position, the locking means comprising a first magnetic member which is attached on the frame and which engages with a second member that can be magnetized so as to hold the restraining bar in the lowered position wherein the locking means include a switch connected to the frame of the seat by a pivot link, and wherein the switch and the magnetic member are situated under the seat.

2. The ski lift seat according to claim 1, wherein the switch includes two ends and respectively made up of a locking member and the magnetizable member.

3. The ski lift seat according to claim 1, wherein the seat includes return means connected to the end of the switch and the frame of the seat.

4. The ski lift seat according to claim 1, wherein the switch comprises a first end on which the magnetizable member is fastened and a second end configured to receive and lock a restraining bar element.

5. The ski lift seat according to claim 4, wherein the second end comprises a bearing surface and a blocking surface, the bearing surface and the blocking surface delimiting a housing designed to receive the restraining bar element.

6. The ski lift seat according to claim 4, further comprising return means opposing the movement of the second end of the switch toward the magnetic member.

7. The ski lift seat according to claim 1, further comprising mechanical unlocking means for the restraining bar.

8. The ski lift seat according to claim 7, wherein the mechanical unlocking means comprise a lever and control means for controlling the lever.

9. The ski lift seat according to claim 8, wherein the control means for controlling the lever comprise a movable control member attached to a hanger of the seat, a mechanical control cable connected to the movable control member and to the lever, and return means opposing the movement of the movable control member toward a position actuating the lever in which the mechanical control cable pulls the lever.

10. The ski lift seat according to claim 9, wherein the movable control member comprises a control switch pivotably mounted on the hanger, the control switch comprising a first end to which the mechanical control cable is attached and a second end comprising a bearing member designed to bear against a ramp.

11. The ski lift seat according to claim 10, wherein the bearing member is a roller pivotably mounted on the second end.

12. The ski lift seat according to claim 1, wherein the magnetic member is a permanent magnet.

13. The ski lift seat according to claim 1, wherein the magnetizable member is a metal plate.

14. A ski lift facility, comprising at least one ski lift seat according to claim 1.

* * * * *